US009967681B2

(12) United States Patent
Oplinger et al.

(10) Patent No.: US 9,967,681 B2
(45) Date of Patent: May 8, 2018

(54) OUTCOME TRACKING IN SENSORY PROSTHESES

(71) Applicant: Cochlear Limited, Macquarie University, NSW (AU)

(72) Inventors: Kenneth Oplinger, St. Leonards (AU); Paul Michael Carter, West Pennant Hills (AU)

(73) Assignee: Cochlear Limited, Macquarie University, NSW (AU)

( * ) Notice: Subject to any disclaimer, the term of this patent is extended or adjusted under 35 U.S.C. 154(b) by 0 days. days.

(21) Appl. No.: 15/454,378

(22) Filed: Mar. 9, 2017

(65) Prior Publication Data

US 2017/0280253 A1 Sep. 28, 2017

Related U.S. Application Data

(60) Provisional application No. 62/312,556, filed on Mar. 24, 2016.

(51) Int. Cl.
*H04R 25/00* (2006.01)
*H04S 1/00* (2006.01)

(52) U.S. Cl.
CPC ..... *H04R 25/407* (2013.01); *H04R 25/305* (2013.01); *H04R 25/505* (2013.01); *H04R 2225/39* (2013.01); *H04S 1/005* (2013.01)

(58) Field of Classification Search
CPC ..... H04R 25/70; H04R 25/664
USPC ..... 381/60, 313, 82, 312, 323, 314, 315; 607/57, 55, 56
See application file for complete search history.

(56) References Cited

U.S. PATENT DOCUMENTS

| | | | | |
|---|---|---|---|---|
| 7,295,676 | B2 | 11/2007 | Chalupper | |
| 8,781,142 | B2 | 7/2014 | Olafsson et al. | |
| 8,798,757 | B2 | 8/2014 | Van den Heuvel | |
| 8,843,204 | B2 | 9/2014 | Garnham et al. | |
| 8,971,554 | B2 | 3/2015 | Van Halteren et al. | |
| 2011/0019846 | A1* | 1/2011 | Anderson | A61B 5/121 381/313 |
| 2011/0200213 | A1 | 8/2011 | Knox | |
| 2011/0249841 | A1 | 10/2011 | Corti et al. | |
| 2013/0121496 | A1 | 5/2013 | Boretzki | |
| 2014/0233743 | A1* | 8/2014 | Hillbratt | G06F 11/22 381/60 |
| 2014/0254817 | A1* | 9/2014 | Vilermo | H04R 1/32 381/74 |
| 2015/0048976 | A1 | 2/2015 | Petersen et al. | |

FOREIGN PATENT DOCUMENTS

WO 2009/055866 A1 5/2009

* cited by examiner

*Primary Examiner* — Melur Ramakrishnaiah
(74) *Attorney, Agent, or Firm* — Edell, Shapiro & Finnan, LLC

(57) ABSTRACT

Presented herein are techniques for detecting sensory outcome issues through an analysis of data representing the direction of incidence/arrival of a sensory input and inertial data representing movement of the recipient's head following detection of the sensory input. By correlating recipient head movement (including lack of movement) with the arrival direction of the sensory input, a sensory prosthesis system can determine whether or not the recipient acted as expected and, if not, whether a sensory outcome problem is present.

23 Claims, 7 Drawing Sheets

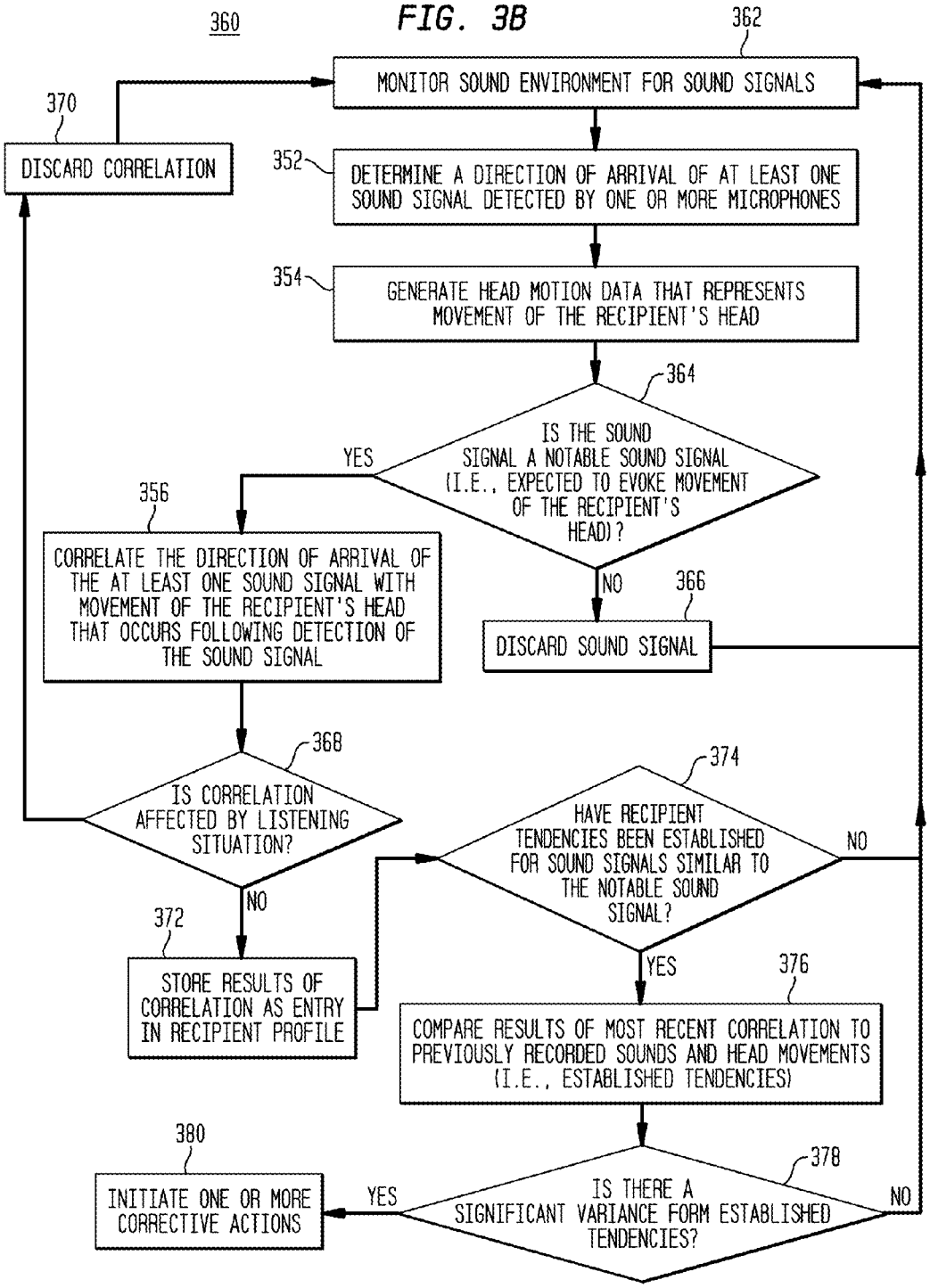
360
FIG. 3B
362
MONITOR SOUND ENVIRONMENT FOR SOUND SIGNALS
370
DISCARD CORRELATION
352
DETERMINE A DIRECTION OF ARRIVAL OF AT LEAST ONE SOUND SIGNAL DETECTED BY ONE OR MORE MICROPHONES
354
GENERATE HEAD MOTION DATA THAT REPRESENTS MOVEMENT OF THE RECIPIENT'S HEAD
364
IS THE SOUND SIGNAL A NOTABLE SOUND SIGNAL (I.E., EXPECTED TO EVOKE MOVEMENT OF THE RECIPIENT'S HEAD)?
YES
356
CORRELATE THE DIRECTION OF ARRIVAL OF THE AT LEAST ONE SOUND SIGNAL WITH MOVEMENT OF THE RECIPIENT'S HEAD THAT OCCURS FOLLOWING DETECTION OF THE SOUND SIGNAL
NO
366
DISCARD SOUND SIGNAL
368
IS CORRELATION AFFECTED BY LISTENING SITUATION?
374
HAVE RECIPIENT TENDENCIES BEEN ESTABLISHED FOR SOUND SIGNALS SIMILAR TO THE NOTABLE SOUND SIGNAL?
NO
NO
372
STORE RESULTS OF CORRELATION AS ENTRY IN RECIPIENT PROFILE
YES
376
COMPARE RESULTS OF MOST RECENT CORRELATION TO PREVIOUSLY RECORDED SOUNDS AND HEAD MOVEMENTS (I.E., ESTABLISHED TENDENCIES)
380
INITIATE ONE OR MORE CORRECTIVE ACTIONS
YES
378
IS THERE A SIGNIFICANT VARIANCE FORM ESTABLISHED TENDENCIES?
NO

OUTCOME TRACKING IN SENSORY PROSTHESES

CROSS-REFERENCE TO RELATED APPLICATIONS

The present application claims priority to U.S. Provisional Application No. 62/312,556, filed Mar. 24, 2016. The entire contents of which are incorporated herein by reference.

BACKGROUND

Field of the Invention

The present invention relates generally to sensory prostheses.

Related Art

Hearing loss, a type of sensory impairment that may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As such, individuals suffering from conductive hearing loss typically receive an auditory prosthesis that generates motion of the cochlea fluid. Such auditory prostheses include, for example, acoustic hearing aids, bone conduction devices, and direct acoustic stimulators.

In many people who are profoundly deaf, however, the reason for their deafness is sensorineural hearing loss. Those suffering from some forms of sensorineural hearing loss are unable to derive suitable benefit from auditory prostheses that generate mechanical motion of the cochlea fluid. Such individuals can benefit from implantable auditory prostheses that stimulate nerve cells of the recipient's auditory system in other ways (e.g., electrical, optical and the like). Cochlear implants are often proposed when the sensorineural hearing loss is due to the absence or destruction of the cochlea hair cells, which transduce acoustic signals into nerve impulses. An auditory brainstem stimulator is another type of stimulating auditory prosthesis that might also be proposed when a recipient experiences sensorineural hearing loss due to damage to the auditory nerve.

For other types of sensory impairment, other types of sensory prostheses are available. For instance, in relation to vision, a sensory prosthesis can take the form of a bionic eye or other type of visual prosthesis.

SUMMARY

In one aspect, a hearing prosthesis system is provided. The hearing prosthesis system comprises: one or more microphones configured to detect a sound signal; at least one processor configured to determine an arrival direction of the sound signal; a memory; an inertial measurement unit configured to generate one or more inertial measurements representing motion of the head of a recipient of the hearing prosthesis system following detection of the sound signal; and a hearing outcome tracking module configured to: associate the one or more inertial measurements representative of the motion of the head of the recipient with the arrival direction of the sound signal; and store the association of the one or more inertial measurements representative of the motion of the head of the recipient with the arrival direction of the sound signal in the memory.

In another aspect, a method is provided. The method comprises determining, with a sensory prosthesis worn on the head of a recipient, a direction of arrival of a sensory input detected by the sensory prosthesis; and correlating the arrival direction of the sensory input with movement of the recipient's head captured following detection of the sensory input at the hearing prosthesis.

BRIEF DESCRIPTION OF THE DRAWINGS

Embodiments of the present invention are described herein in conjunction with the accompanying drawings, in which:

FIG. 3B is a detailed flowchart of a method in accordance with embodiments presented herein;

DETAILED DESCRIPTION

Figure 1:
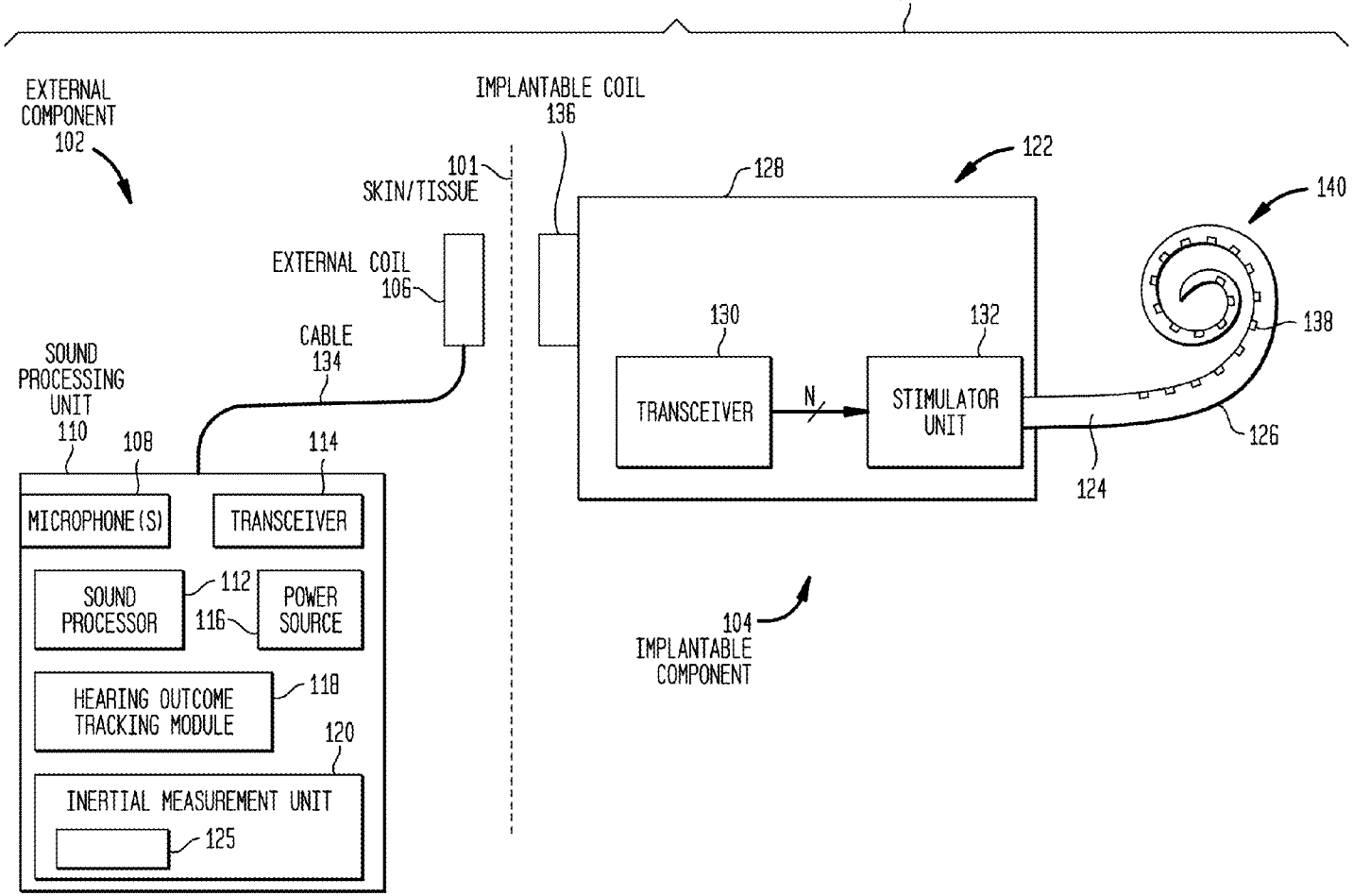
FIG. 1 is a block diagram of a cochlear implant in accordance with embodiments presented herein.

The effectiveness of certain sensory prostheses, such as hearing prostheses, depends on how well the prosthesis is configured or "fit" to the recipient of a particular prosthesis. For instance, the "fitting" of a hearing prosthesis to a recipient, sometimes also referred to as "programming" or "mapping," creates a set of configuration settings and other data that defines the specific operational characteristics of the hearing prosthesis. In the case of cochlear implants, fitting determines how the cochlear implant operates to convert detected sound signals (sounds) into stimulation signals that are delivered to the recipient's auditory nerve to evoke perception of the sound signals.

After being fitted with a hearing prosthesis, a recipient's hearing abilities, particularly residual hearing abilities, the operation of the prosthesis itself, and/or cognitive abilities (e.g., memory, understanding of information, spatial skills, attention) can decline (i.e., negatively change). As a result, some hearing prosthesis recipients will, over time, experience poorer outcomes as a result of these decline(s). It is also the case that a hearing prosthesis may not be properly fit to a recipient during the initial fitting process. Declines in a recipient's hearing ability, hearing prosthesis operation, and cognitive ability, as well as a hearing prosthesis that is improperly fit to a recipient, can all negatively affect the end performance of the hearing prosthesis in addressing the recipient's particular hearing loss (i.e., affect the hearing outcome experienced by the recipient). As such, recipient declines (i.e., declines in the recipient's hearing or cognitive ability), operational declines (i.e., declines in operation of the hearing prosthesis itself), and improper prosthesis fittings are collectively and generally referred to herein as hearing outcome problems/issues.

In conventional arrangements, hearing outcome problems are only detected/identified within a clinical environment, typically using complex equipment and techniques implemented by trained audiologists/clinicians. Recipients often do not visit clinics on a regular basis due to, for example, costs, low availability of trained audiologists, such as in rural areas, etc. Therefore, the need to visit a clinic in order to detect a hearing outcome problem may not only be cost prohibitive for certain recipients, but may also require the recipient to live with the hearing outcome problem (possibly unknowingly) for a significant period of time before the hearing outcome problem is even identified, let alone addressed.

As such, presented herein are techniques that enable a hearing prosthesis system itself to detect hearing outcome problems outside of a clinical setting (i.e., while the recipient uses the hearing prosthesis for his/her daily activity). Once a hearing outcome problem is detected, the hearing prosthesis system may immediately initiate one or more corrective actions to, for example, address the hearing outcome problem.

More particularly, embodiments of the present invention are generally directed to techniques for detecting hearing outcome issues through an analysis of data representing the direction of incidence/arrival of a sound signal (i.e., the direction from which the sound signal originated) and inertial data representing movement of the recipient's head following detection of the sound signal. That is, embodiments presented herein use inertial measurements generated by one or more inertial sensors (e.g., accelerometers) to track recipient head movements in response to the detection of certain sound signals, such as sound signals that should result in a head turn. By correlating recipient head movement (which as defined herein includes detection of lack of head movement) with the arrival direction of the sound signals, a hearing prosthesis system can determine whether or not the recipient acted as expected and, if not, whether a hearing outcome problem is present. As a result, hearing outcome problems can be identified by the hearing prosthesis itself, without the recipient needing to take any action (i.e., the techniques presented herein may be implemented as background operations that do not affect the recipient).

For ease of illustration, embodiments are primarily described herein with reference to one type of auditory/hearing prosthesis, namely a cochlear implant. However, it is to be appreciated that the techniques presented herein may be used with other hearing prostheses, such as auditory brainstem stimulators, direct acoustic stimulators, bone conduction devices, etc. It is also to be appreciated that the techniques presented herein may be used with other types of sensory prostheses, such as visual prostheses, to detect other types of recipient declines and/or operational declines. When aspects of the present invention are applied to other sensory prostheses, as described elsewhere herein, recipient declines, operational declines (i.e., declines in operation of the sensory prosthesis itself), and improper prosthesis fittings are sometimes collectively referred to herein as sensory outcome problems/issues. As such, hearing outcome issues are a specific type/category of sensory outcome issues that may be detected through implementation of the techniques presented herein.

Figure 2:
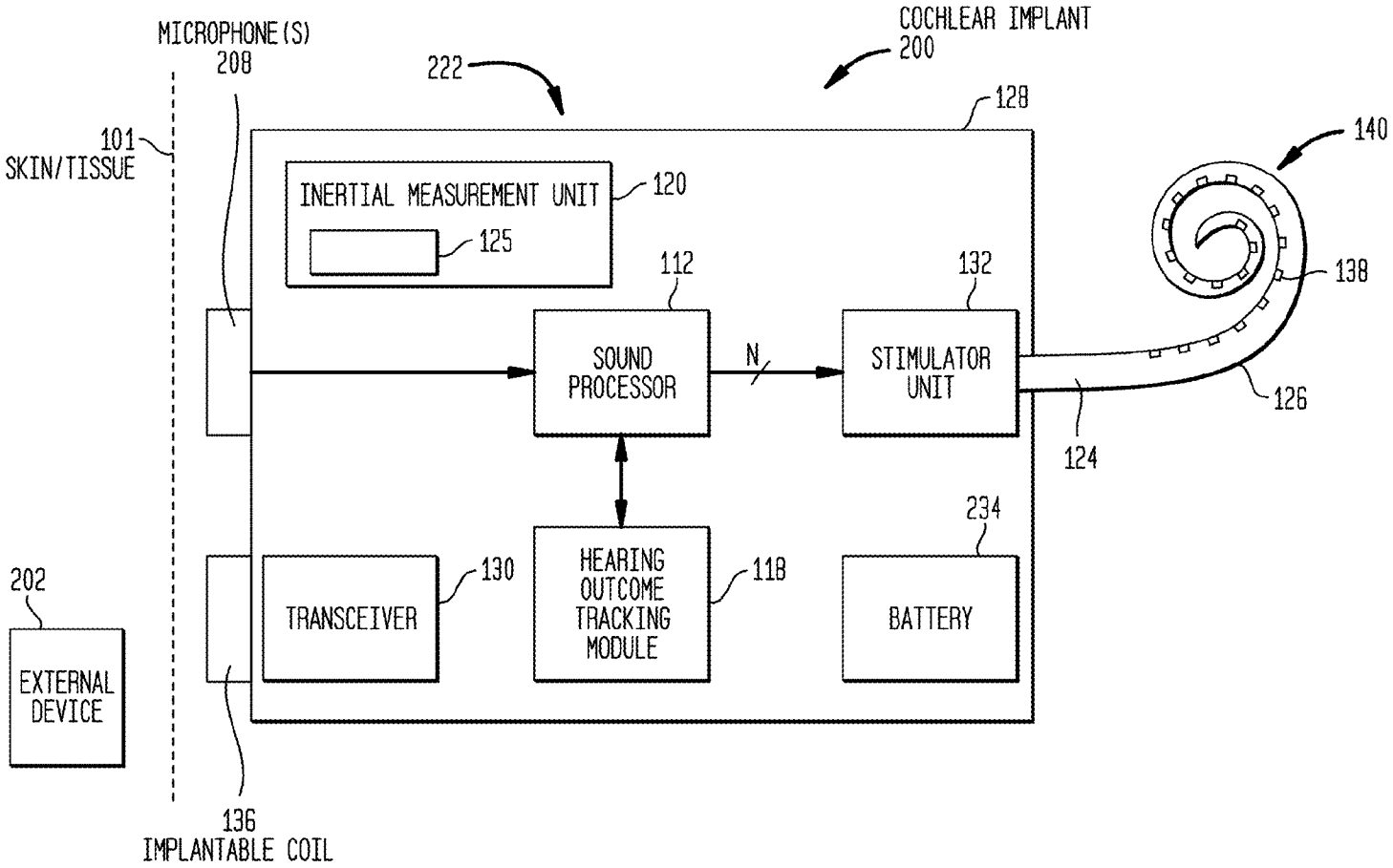
FIG. 2 is a block diagram of a totally implantable cochlear implant in accordance with embodiments presented herein.

FIGS. 1 and 2 are block diagrams of illustrative cochlear implants configured to implement the techniques presented herein. More specifically, FIG. 1 illustrates an example arrangement in which a cochlear implant 100 includes an external component 102 and an internal/implantable component 104. The external component 102 is configured to be directly or indirectly attached to the body of a recipient, while the implantable component 104 is configured to be subcutaneously implanted within the recipient (i.e., under the skin/tissue 101 of the recipient).

The external component 102 comprises an external coil 106 and a sound processing unit 110 connected via, for example, a cable 134. The external coil 106 is typically a wire antenna coil comprised of multiple turns of electrically insulated single-strand or multi-strand platinum or gold wire. Generally, a magnet (not shown in FIG. 1) is fixed relative to the external coil 106.

The sound processing unit 110 comprises one or more microphones 108, a sound processor 112, an external transceiver unit (transceiver) 114, a power source 116, a hearing outcome tracking module 118, and an inertial measurement unit (IMU) 120. The sound processing unit 110 may be, for example, a behind-the-ear (BTE) sound processing unit or other type of processing unit worn on the recipient's head.

The implantable component 104 comprises an implant body (main module) 122, a lead region 124, and an elongate intra-cochlear stimulating assembly 126. The implant body 122 generally comprises a hermetically-sealed housing 128 in which an internal transceiver unit (transceiver) 130 and a stimulator unit 132 are disposed. The implant body 122 also includes an internal/implantable coil 136 that is generally external to the housing 128, but which is connected to the transceiver 130 via a hermetic feedthrough (not shown in FIG. 1). Implantable coil 136 is typically a wire antenna coil comprised of multiple turns of electrically insulated single-strand or multi-strand platinum or gold wire. The electrical insulation of implantable coil 136 is provided by a flexible molding (e.g., silicone molding), which is not shown in FIG. 1. Generally, a magnet (not shown in FIG. 1) is fixed relative to the implantable coil 136.

Elongate stimulating assembly 126 is configured to be at least partially implanted in the recipient's cochlea (not shown in FIG. 1) and includes a plurality of longitudinally spaced intra-cochlear stimulating contacts (e.g., electrical and/or optical contacts) 138 that collectively form a contact array 140. Stimulating assembly 126 extends through an opening in the cochlea (e.g., cochleostomy, the round window, etc.) and has a proximal end connected to stimulator unit 132 via lead region 124 and a hermetic feedthrough (not shown in FIG. 1). As such, lead region 124 couples the stimulating assembly 126 to the implant body 122 and, more particularly, stimulator unit 132.

Returning to external component 102, the microphone(s) 108 are configured to detect/receive sound signals and generate electrical microphone output signals therefrom. These microphone output signals are representative of the detected sound signals. In addition to the one or more microphones 108, the sound processing unit 110 may include other types of sound input elements (e.g., telecoils, audio inputs, etc.) to receive sound signals. However, merely for ease of illustration, these other types of sound input elements have been omitted from FIG. 1.

The sound processor 112 is configured execute sound processing and coding to convert the microphone output signals, and/or signals from other sound input elements, into coded data signals that represent stimulation for delivery to the recipient. The transceiver 114 receives the coded data signals from the sound processor 112 and transcutaneously transfers the coded data signals to the implantable component 104 via external coil 106. More specifically, the magnets fixed relative to the external coil 106 and the implantable coil 136 facilitate the operational alignment of the external coil 106 with the implantable coil 136. This operational alignment of the coils enables the external coil 106 to transmit the coded data signals, as well as power signals received from power source 116, to the implantable coil 136. In certain examples, external coil 106 transmits the signals to implantable coil 136 via a radio frequency (RF) link. However, various other types of energy transfer, such as infrared (IR), electromagnetic, capacitive and inductive transfer, may be used to transfer the power and/or data from an external component to a cochlear implant and, as such, FIG. 1 illustrates only one example arrangement.

In general, the coded data and power signals are received at the transceiver 130 and provided to the stimulator unit 132. The stimulator unit 132 is configured to utilize the coded data signals to generate stimulation signals (e.g., current signals) for delivery to the recipient's cochlea via one or stimulating contacts 138. In this way, cochlear implant 100 stimulates the recipient's auditory nerve cells, bypassing absent or defective hair cells that normally transduce acoustic vibrations into neural activity, in a manner that causes the recipient to perceive the received sound signals.

As described further below, the sound processor 112 is also configured to determine the incidence/arrival direction of sound signals detected by the one or more microphones 108. Following detection of a sound signal, the sound processor 112 generates sound signal direction data (i.e., data indicative of the direction from which the sound signal originated) and provides this data to the hearing outcome tracking module 118. Also as described further below, the sound processor 112 may generate situation data representative of attributes of the current listening situation of the recipient. This situational data may also be provided to the hearing outcome tracking module 118.

As noted above, the sound processing unit 110 includes the inertial measurement unit 120. The inertial measurement unit 120 is configured to measure the inertia of the recipient's head, that is, motion of the recipient's head. As such, inertial measurement unit 120 comprises one or more sensors 125 each configured to sense one or more of rectilinear or rotatory motion in the same or different axes. Examples of sensors 125 that may be used as part of inertial measurement unit 120 include accelerometers, gyroscopes, compasses, and the like. Such sensors may be implemented in, for example, micro electromechanical systems (MEMS) or with other technology suitable for the particular application.

As noted above, the inertial measurement unit 120 illustrated in FIG. 1 is disposed in the sound processing unit 110, which forms part of external component 102, which is in turn configured to be directly or indirectly attached to the body of a recipient. The attachment of the inertial measurement unit 120 to the recipient has sufficient firmness, rigidity, consistency, durability, etc. to ensure that the accuracy of output from the inertial measurement unit 120 is sufficient for use in the systems and methods described herein. For instance, the looseness of the attachment should not lead to a significant number of instances in which head movement that is consistent with the direction of a notable sound (as described below) is not identified as such nor a significant number of instances in which head movement that is inconsistent with the direction of a notable sound is not identified as such. In the absence of such an attachment, the inertial measurement unit 120 must accurately reflect the recipient's head movement using other techniques.

The data collected by the sensors 125 is sometimes referred to herein as head motion data. The inertial measurement unit 120 is configured to provide the head motion data to the hearing outcome tracking module 118. As described further below, the hearing outcome tracking module 118 is configured to correlate the head motion data with the sound direction data (and in some embodiments, the situational data) received from the sound processor 112 to identify hearing outcome problems experienced by the recipient.

FIG. 1 illustrates an arrangement in which the cochlear implant 100 includes an external component 102. However, it is to be appreciated that embodiments of the present invention may be implemented in cochlear implants having alternative arrangements. For example, FIG. 2 is a functional block diagram of an exemplary totally implantable cochlear implant 200 configured to implement embodiments of the present invention. That is, in the example of FIG. 2, all components of the cochlear implant 200 are configured to be implanted under the skin/tissue 101 of the recipient. Because all components of cochlear implant 200 are implantable, cochlear implant 200 operates, for at least a finite period of time, without the need of an external device.

Cochlear implant 200 includes an implant body 222, lead region 124, and elongate intra-cochlear stimulating assembly 126. Similar to the example of FIG. 1, the implant body 222 generally comprises a hermetically-sealed housing 128 in which transceiver 130 and stimulator unit 132 are disposed. However, in the specific arrangement of FIG. 2, the implant body 222 also includes the sound processor 112, the tracking module 118, and the inertial measurement unit 120, all of which were part of the external component 102 in FIG. 1. The implant body 222 also includes the implantable coil 136 and one or more implantable microphones 208 that are generally external to the housing 128. Similar to implantable coil 136, the implantable microphones 208 are also connected to the sound processor 112 via a hermetic feedthrough (not shown in FIG. 2). Finally, the implant body 222 comprises a battery 234.

Similar to the example of FIG. 1, the microphones 208, possibly in combination with one or more external microphones (not shown in FIG. 2), are configured to detect/receive sound signals and generate electrical microphone output signals therefrom. These microphone output signals are representative of the detected sound signals. The sound processor 112 is configured execute sound processing and coding to convert the microphone output signals, and/or signals from other sound input elements (not shown in FIG. 2), into data signals. The stimulator unit 132 is configured to utilize the data signals to generate stimulation signals for delivery to the recipient's cochlea via one or stimulating contacts 138, thereby evoking perception of the sound signals detected by the microphones.

The transceiver 130 permits cochlear implant 200 to receive signals from, and/or transmit signals to, an external device 202. The external device 202 can be used to, for example, charge the battery 234. In such examples, the external device 202 may be a dedicated charger or a conventional cochlear implant sound processor. Alternatively, the external device 202 can include one or microphones or sound input elements configured to generate data for use by the sound processor 112. External device 202 and cochlear implant 200 may be collectively referred to as forming a cochlear implant system.

The examples of FIGS. 1 and 2 illustrate that a hearing outcome tracking module in accordance embodiments of the present invention can be implemented as part of different portions of a hearing prosthesis and in hearing prostheses having different arrangements. It is also to be appreciated that a hearing outcome tracking module in accordance embodiments of the present invention can be implemented as part of an external device that operates with a cochlear implant or other hearing prosthesis (i.e., part of a hearing prosthesis system). For example, a hearing outcome tracking module can be implemented as part of a mobile electronic device (e.g., a remote control device, a smartphone, etc.) that operates with a cochlear implant or other hearing prosthesis.

Figure 3A:
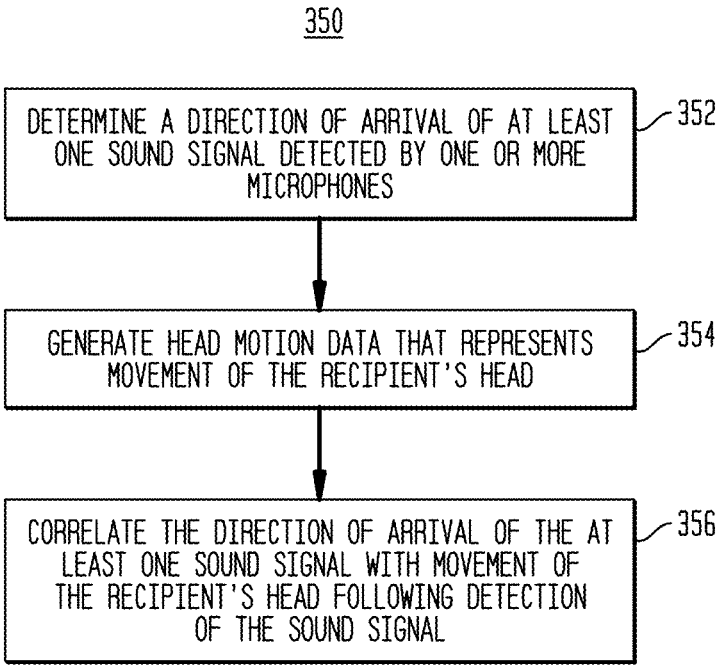
FIG. 3A is a high-level flowchart of a method in accordance with embodiments presented herein.

FIG. 3A is a high-level flowchart illustrating a method 350 in accordance with embodiments of the present invention. Merely for ease of illustration, method 350 will be described with reference to the example cochlear implant 100 of FIG. 1.

Method 350 begins at 352 where the sound processor 112, and/or another element of cochlear implant 100, determines a direction of arrival (DOA) of at least one sound signal detected by the one or more microphones 108. In general, the sound processor 112 (or other element) executes one or more direction of arrival calculation techniques to generate a sound direction output that represents the arrival direction of the sound signal. There are a number of techniques that may be implemented to determine the arrival direction of a sound signal detected by the one or more microphones 108. For example, in one specific implementation, cochlear implant 100 comprises at least two microphones 108 that are located some distance apart from one another and the arrival direction of a sound signal is determined based on the relative delays of when the sound signal is detected by (i.e., arrives at) the at least two microphones. That is, given the relative delays and the known separation distance between the at least two microphones, the arrival direction of the sound signal can be determined. This technique is merely illustrative and it is to be appreciated that other techniques for determining the arrival direction of a sound signal can be also be implemented in accordance with embodiments presented herein.

Figure 4:
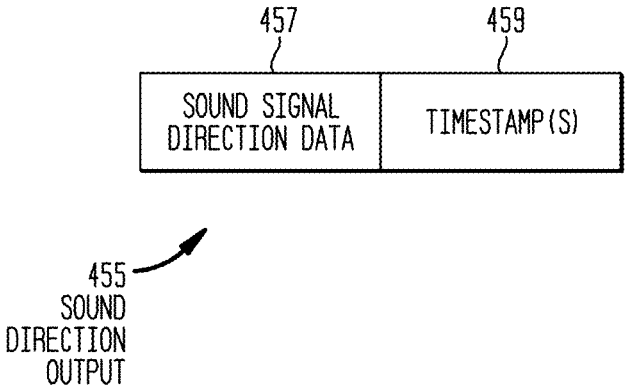
FIG. 4 is a schematic diagram illustrating a sound direction output generated for use in accordance with embodiments presented herein.

After the direction of arrival of the sound signal is determined, the sound direction output is provided to hearing outcome tracking module 118. The sound direction output includes a block of sound signal direction data identifying the arrival direction of the sound signal. In certain examples, the sound direction output may also include one or more time stamps that indicate the time at which the sound signal was detected by the one or more microphones 118. The one or more time stamps may be referenced to a system clock for the cochlear implant 100. FIG. 4 is a schematic diagram illustrating an example sound direction output 455 that comprises sound signal direction data 457 and one or more time stamps 459. If multiple time stamps are present, then the time stamps may each be associated with a different portion of the sound signal.

Returning to the example of FIG. 3A, at 354 the method 350 further comprises, capturing/determining, with the sensors 125 of inertial measurement unit 120, head motion data that represents movement of the recipient's head. As used herein, capturing or determining movement of a recipient's head encompasses/includes capturing an absence of movement of the recipient's head. That is, head motion data may indicate one or both of movement or lack of movement of the recipient's head.

Figure 5:
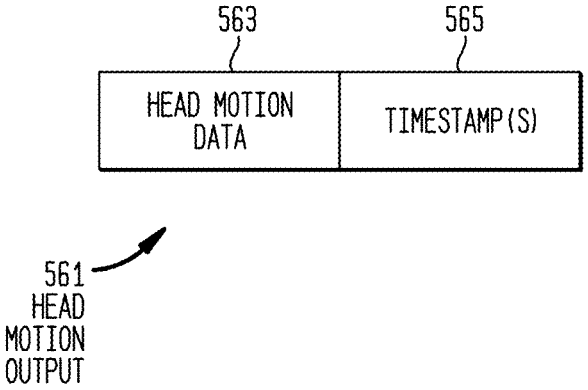
FIG. 5 is a schematic diagram illustrating a head motion output generated for use in accordance with embodiments presented herein.

In certain embodiments, the inertial measurement unit 120 is configured to combine the head motion data with one or more time stamps to generate a head motion output. FIG. 5 is a schematic diagram illustrating an example head motion output 561 that may be generated by the inertial measurement unit 120. As shown, the head motion output 561 includes the head motion data 563 and one or more time stamps 565. If multiple time stamps are present, then the time stamps may each be associated with a different portion of the head motion data so as to indicate a time at which different motions occurred.

Again returning to the example of FIG. 3A, at 365 the method 350 further comprises, correlating the arrival direction of the sound signal with movement of the recipient's head. More specifically, the hearing outcome tracking module 118 is configured to receive the sound direction output that includes the sound signal direction data and to receive the head motion output that includes the head motion data. The hearing outcome tracking module 118 determines a correlation of any motion of the recipient's head (including lack of motion) that occurs following detection of the sound signal, with the arrival direction of the sound signal. In other words, upon detection of certain sound signals, the hearing outcome tracking module 118 is configured to analyze how the recipient's head moves (or doesn't move) in response to the direction of these sound signals and, potentially, the timing of any movements relative to the time at which the sound signal is detected (e.g., using the time stamp(s) associated with the sound signal direction data and head motion data).

Correlation of arrival direction of the sound signal with the recipient's head movement can allow the hearing prosthesis to determine, for example, whether the recipient perceived (i.e., heard) the sound signal in an expected manner. For example, the correlation may be used to determine whether or not the head movement is consistent with the direction of the detected sound. In one example, if the recipient looks in the wrong direction following detection of the sound signal, then the correlation may result in a determination that the recipient did not properly perceive the sound signal. Another aspect of the correlation is the timing of the head movement to receipt of the sound signal. In particular, the head movement should be timed so as to occur immediately, without undue delay, etc., after stimulation signals representative of the sound signal are delivered to the recipient. The hearing outcome tracking module 118 may be aware of any inherent delays in the processing and stimulation operations of the cochlear implant 100. As such, during the correlation, the hearing outcome tracking module 118 may consider these delays, along with the time stamps, and the head motion data (e.g., speed of the movement, degrees of rotation, angle, response time, etc.) to determine if the head movement is correlated, in time, with the direction of arrival of the sound signal so as to reveal whether the recipient perceived the sound signal in an expected manner.

As noted, the correlation may reveal whether or not the recipient's head movement is in accordance with expected movements of the recipient's head. Expected head movements may include, pre-determined (e.g., estimated) movements of a typical recipient's head in response to the sound signal or a similar sound signal, and/or movements that are specific to the recipient (e.g., during an earlier fitting or training process).

Referring next to FIG. 3B, a flowchart of a detailed method 360 in accordance with embodiments of the present invention is illustrated. Again, for ease of illustration, FIG. 3B is also described with reference to cochlear implant 100 of FIG. 1. As shown, method 360 begins at 362 where the cochlear implant 100 monitors the current sound environment for sound signals. The cochlear implant 100 monitors the sound environment with the one or more microphones 108.

After a sound signal is detected by the one or more microphones 108, method 360 further comprises, at 352, determining a direction of arrival of the sound signal and generating a sound direction output for use by the hearing outcome tracking module 118. The method 360 also comprises, at 354, capturing head motion data that represents movement of the recipient's head and generating a head motion output for use by the hearing outcome tracking module 118. FIG. 3B also includes determining a correlation between the direction of arrival of a sound signal and head movement of the recipient at 356. The operations of 352, 354, and 356 were all described in detail with reference to FIG. 3A.

In accordance with certain embodiments of the present invention, a correlation between the direction of arrival of a sound signal and head movement of a recipient is only determined for sound signals that are first determined to be "notable" sound signals. As used herein, notable sound signals are sound signals that, if processed and converted to stimulation signals for delivery to the recipient in accordance with a predetermined configuration settings, are expected to evoke/cause specific movement of a recipient's head. Stated differently, notable sound signals are sound signals that are expected to be perceived by the recipient in a manner that elicits a predetermined type of head motion, such as a head turn. Therefore, in the embodiment of FIG. 3B, prior to determining a correlation between the sound arrival direction and head movement of the recipient at 356, the method 360 first comprises, at 364, a determination of whether or not the detected sound signal is a notable sound signal.

There are number of different types of sound signal parameters that may be evaluated at 364 in order to determine whether or not the sound signal is a notable sound signal. As described further below, these sound signals parameters are not mutually exclusive and may be analyzed alone and/or in various combinations in order to determine whether a sound signal is a notable sound signal.

In certain embodiments, a sound signal parameter that is used to determine whether or not a sound signal is a notable sound signal is the direction of arrival of the sound signal. For example, sound signals originating from in front of the recipient may not be notable sound signals because the recipient is already looking towards the source of the sound signal. If the recipient is already looking towards the source of the sound signal, then there is no expectation that the recipient will move his/her head when the sound signal is detected (i.e., the recipient's head will remain stationary as he/she remains focused on the source of the sound signal). As such, in one embodiment, the hearing outcome tracking module 118 determines that a sound signal is a notable sound signal only when the direction of the arrival of the sound signal is from a spatial region directly behind the head of the recipient of the hearing prosthesis (e.g., within an approximately thirty to sixty degree wide region centered at the mid-point of the back of the recipient's head). In another embodiment, the hearing outcome tracking module 118 determines that a sound signal is a notable sound signal only when the direction of the arrival of the sound signal is from a spatial region that is not visible to the recipient, at the time the sound signal is detected, without movement of the recipient's head. These specific spatial regions (i.e., behind the head—including above, below or to the side of the head—or otherwise not visible without some degree of head movement) can be determined, for example, during an initial fitting process and preprogrammed for use by the hearing outcome tracking module 118.

The determination of whether a sound signal is a notable sound signal may further include an analysis of non-directional sound signal parameters (i.e., parameters other than sound arrival direction). Non-directional sound signal parameters that may be included in the analysis are, for example, a level (e.g., amplitude), a frequency (e.g., average frequency, maximum frequency, minimum frequency, etc.), or a frequency range of the sound signal. Therefore, in addition to determining a direction of arrival of a sound signal, the sound processor 112 or other element of cochlear implant 100 may also be configured to determine one or more of a level, frequency, or frequency range of the sound signal.

In certain embodiments, the hearing outcome tracking module 118 determines that a sound signal is a notable sound signal only when the level of the sound signal is greater than a threshold level. In one such embodiment, the threshold is a difference between an ambient noise level and the level of the sound signal.

For hearing prostheses that rely on residual hearing and/or acoustic transducers, the frequency or frequency range may also be relevant to whether a sound signal is a notable sound signal. For example, in such hearing prostheses, notable sound signals are sound signals in which a significant portion of the signal energy is within a frequency range of the acoustic stimulation and/or residual hearing. This is particularly important for hearing prostheses with both an electric and an acoustic output. In some such devices, the delivery of signals based on the sound signal is governed partly by frequency, e.g., high frequency portions of the sound are typically delivered via the electric output and low frequency portions of the sound are typically delivered via the acoustic output. Whether the significant portion of the signal energy is within one or the other of these frequency ranges can partly determine any corrective actions taken in response to a failure on the part of the recipient to respond to the sound. For instance, if the significant portion of the signal energy is within the high frequency range, the configuration of the electric output can be adjusted. Such corrective action might be fully automated and not require a visit to an audiologist. However, if the significant portion of the signal energy is within the low frequency range, then the hearing prosthesis might need to be replaced if the recipient is no longer capable of responding to acoustic output due to the loss of residual hearing. Such corrective action is significantly more burdensome than automated reconfiguration.

Another non-directional sound parameter that may be used to identify a notable sound is the content of the sound signal. For example, notable sounds can include specific words (e.g., the recipient's name or panic words), phrases, particular voice characteristics (e.g., indicating a particular voice), etc. In some embodiments, the hearing outcome tracking module 118 is trained to recognize specific words, phrases, etc. This training can be performed in a clinical setting with an audiologist or at home using, for example, a mobile device application or other interface to the hearing prosthesis. Once trained to, e.g., identify a particular word spoken by a specific person, e.g., the recipient's name spoken by a caregiver, the hearing outcome tracking module 118 in some embodiments adjusts one or more other requirements for identifying a notable sound. For instance, if a recipient's partner calls out the recipient's name, the recipient is expected to look toward her partner, even if the partner does not shout.

Returning to FIG. 3B, if it is determined at 364 that the detected sound signal is not a notable sound signal, then, at 366, the sound signal is discarded from further processing by the hearing outcome tracking module 118. Method 360 then returns to 362 for further monitoring of the sound environment for sound signals.

However, if it is determined at 364 that the sound signal is a notable sound signal, then method 360 proceeds to 356 where, as described above, the direction of arrival of the sound signal (i.e., the notable sound signal) is correlated with movement of the recipient's head that occurs following (i.e., after), the sound signal is detected by the microphones 108.

A recipient may be exposed to different listening situations at different times and a recipient's particular listening situation at the time a sound signal is detected may affect whether or not the recipient perceives the sound signal and acts as expected. Stated differently, movement or lack of movement of a recipient's head in response to detection of a notable sound signal may be affected by situational circumstances that are not directly related to the operation of the cochlear implant 100, the recipient's residual hearing, or cognitive abilities. Therefore, FIG. 3B illustrates that, at 368, a determination is made as to whether or not the correlation of the direction of arrival of the sound signal with movement of the recipient's head is affected by the recipient's current listening situation.

If it is determined at 368 that the correlation has likely been affected by the recipient's particular listening situation, then the method 360 proceeds to 370 where the correlation is discarded (i.e., not utilized for further analysis by the hearing outcome tracking module 118). However, it if is determined at 368 that the correlation has likely not been affected by the recipient's particular listening situation, then the method 360 proceeds to 372 where the results of the correlation are stored as an entry in the recipient's hearing outcome profile. Further details of the recipient's hearing outcome profile are provided below.

There are number of different types or pieces of situational data that may be evaluated at 368 to determine whether or not a correlation of sound signal arrival direction to head movement has been affected by the recipient's listening situation. These types of situational data are not mutually exclusive and may be analyzed alone and/or in various combinations.

In one embodiment, situational data that may be evaluated at 368 comprises, for example, a sound environment classification. More specifically, the sound processor 112 may include an environmental classifier (e.g., environmental classification function) that operates to "classify" the sound signal and the sound environment of the hearing prosthesis into one or more categories, such as "noise," "quite," "speech in quiet," "speech in noise," etc. Therefore, in addition to the sound direction output, the sound processor 112 may provide the hearing outcome tracking module 118 with environmental classification data associated with the sound signal.

In an illustrative example, the environmental classifier may classify the environment as "quiet," "speech in quiet," or other classification indicating there are only low levels of noise at the time the notable sound signal is detected. In such environments, it is expected that the notable sound would produce a head movement because there is little or no ambient noise that could prevent the recipient from perceiving the notable sound signal. As such, since the recipient's head movement has likely not been affected by any noise, the correlation of that head movement with the direction of the notable sound signal may stored for subsequent use (i.e., proceed to 372).

In contrast, environments determined by the environmental classifier to include high levels of noise may result, for example, in the notable sound signal being heard but ignored by the recipient, or the notable sound signal simply not being heard clearly or loudly enough to produce a detectable head movement. In such examples, since the recipient's head movement has likely been affected by the noise, a failure of the recipient to respond as expected to the notable sound signal may not be a good indicator of a hearing outcome problem (e.g., a decline in a recipient's hearing ability, decline hearing prosthesis operation, a decline in cognitive ability, as and/or an improperly fit prosthesis). Therefore, as noted above, the correlation of that head movement with the direction of the notable sound signal is discarded (at 370) and not used for further analysis by the hearing outcome tracking module 118.

Another type of situational data that may be evaluated at 368 to determine whether or not a correlation has been affected by the recipient's listening situation is the recipient's activity level at the time the notable sound signal is detected. In particular, certain activities make it more or less likely that a notable sound signal will be perceived by the recipient in a manner that evokes an expected head movement. For example, if the recipient is sleeping and the recipient's head does not move in response to, for example, a question (e.g., "Are you awake?"), then the lack of head movement may not be a good indicator of a hearing outcome problem. Moreover, if the recipient is already moving at the time the notable sound signal is detected (e.g., running, jumping, roughhousing, etc.), head movement that might otherwise be readily identifiable as a response to a notable sound could be part of an ongoing series of movements unrelated to the notable sound. In addition, the recipient could be driving a car, playing sports, or engaged in another activity that requires focus on the activity. If, for example, the recipient is driving a car, which could be known to the recipient's hearing prosthesis in any number of ways, the recipient might not be able to move his/her head in response to a notable sound. Therefore, a failure of a recipient to move his/her head when the recipient is involved in certain activities may not be a good indicator of a hearing outcome problem. Therefore, as noted above, when the recipient's activity level indicates that the recipient is engaged in certain activities that may affect the detected head movement, then the correlation of that head movement with the direction of the notable sound signal is discarded (at 370) and not used for further analysis by the hearing outcome tracking module 118.

A number of systems have been developed for determining the activity level of a recipient. These systems may be part of cochlear implant 100 and used in conjunction with implementations of the present invention.

Another type of situational data that may be evaluated at 368 to determine whether or not a correlation has been affected by the recipient's listening situation is the relative timing of the notable sound signal to other sound signals. For example, if a notable sound immediately follows a similar sound from a similar direction, a failure to respond might not be a good indicator of a hearing outcome problem. Such sounds may include, for instance, an alarm of which the recipient is already aware.

Figure 6:
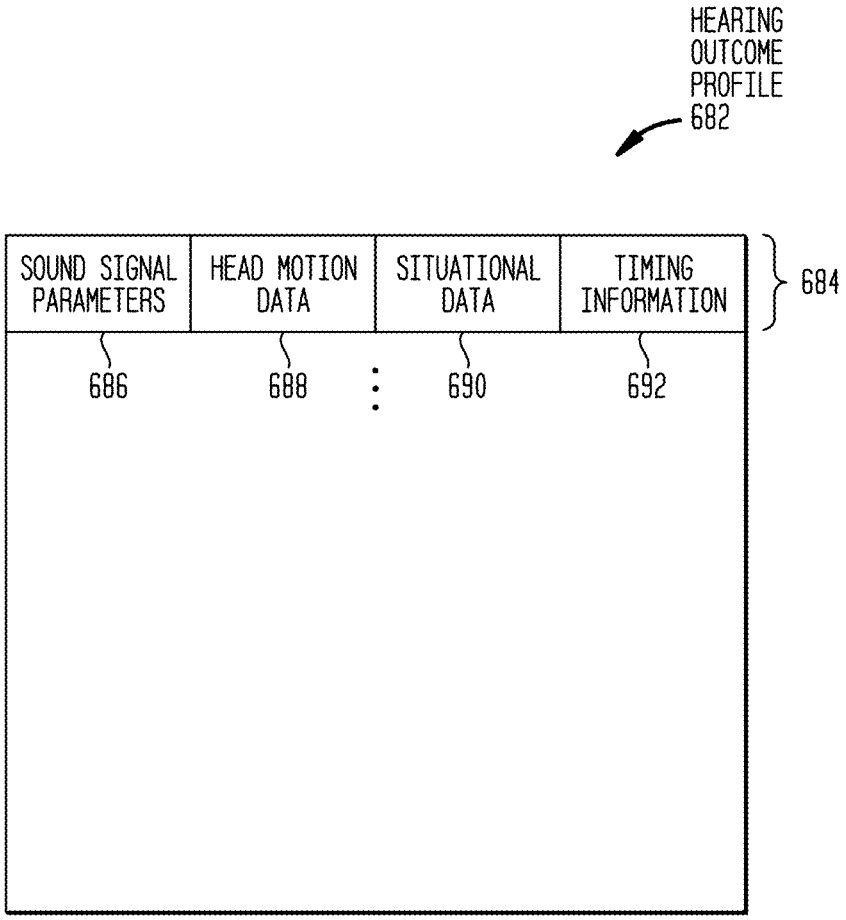
FIG. 6 is a schematic diagram illustrating a hearing outcome profile in accordance with embodiments presented herein.

As noted above, if it is determined that the recipient's listening situation (e.g., listening environment, activity level, relative sound timing, etc.) has not affected the correlation of the direction of arrival of the notable sound signal to the recipient's head movement made at 356, then at 372 the results of the correlation are stored as an entry in a recipient's hearing outcome profile. FIG. 6 is a schematic diagram illustrating an example entry 684 that may be made in a recipient's hearing outcome profile 682.

As shown in FIG. 6, the data that is recorded may include the notable sound signal parameters 686 (e.g., direction of arrival, frequency, frequency range, level, etc.). If the notable sound is a specific name, word, phrase, voice characteristics, etc., then the recorded data could also include an indication of the specific name, word, phrase, voice characteristics, etc. The recorded data may also include head motion data 688, such as speed of head movement, degrees of head rotation, angle, response time, etc. Also as shown in FIG. 6, the recorded data may include situational data 690, such as the environment classification, the background noise level, the location of the recipient, the recipient's activity level, etc. The hearing outcome profile entry 684 may also include timing information 692, such as the time of day the notable sound signal was detected, the relative timing of the head motion to the sound signal detection, etc. Provided a suitable prosthesis/system is in use, the notable sound can also be recorded for subsequent analysis.

In certain arrangements, a single correlation of the direction of arrival of a sound signal to head motion is sufficient to cause the hearing prosthesis to initiate a corrective action. For example, the detection of approaching or increasing sounds (e.g., beeping), panic words, such as "run" or "fire," could be an indication of danger. In such circumstances, if the hearing outcome tracking module 118 detects such sounds and determines that these sounds are correlated with an unexpected head movement (i.e., the recipient fails to look at the source of the sound signal), then the hearing outcome tracking module 118 can determine that the recipient did not perceive the sound signal. As a result, the hearing outcome tracking module 118 can cause other components of cochlear implant 100 to (a) increase the perceptual level of hearing prosthesis output delivered to the recipient for a period of time, e.g., for the duration of a specific period of time or until the expected head movement is detected, and/or (b) re-deliver the sound signal to the recipient with, for example, an increased output level so that the recipient is able to perceive the sound signal and avoid danger. In other circumstances, a recipient's failure to respond to the recipient's name may be determined to be an indication of behavioral problems in the case of minor recipients, injury or incapacitation in the case of any recipient and confusion or other issues in the case of recipients with dementia that requires another corrective action. In such circumstances, corrective action can be the triggering of external alarms or delivery of communications to a caregiver via paired and/or connected communication devices.

In other embodiments, a failure of a recipient to respond appropriately to a notable sound from time to time is insufficient to determine whether or not there is a hearing outcome problem. As noted above, a benefit of the techniques presented herein is that the techniques are implemented in the background outside of a clinical setting (i.e., while the recipient uses the cochlear implant 100 for his/her daily activity). As such, since the correlation of the direction of arrival of a sound signal to head motion does not occur in a controlled environment, correlations should generally be gathered and analyzed over longer periods of time before drawing hearing outcome conclusions.

Gathering correlations over a period of time (e.g., months, if not years) results in a hearing outcome profile with multiple entries of head motions correlated with notable sounds possible in various listening situations. In other words, the hearing outcome profile is built to a sufficient sample size so that the hearing outcome tracking module 118 can identify/establish recipient-specific tendencies (recipient tendencies). Identification of recipient tendencies includes, for example, a determination of whether the recipient's head regularly moves or does not move in response to particular sound signals under certain conditions. Therefore, as shown in FIG. 3B, after the results of a correlation are stored in a recipient's profile, at 374 the hearing outcome tracking module 118 determines whether recipient tendencies have been established for sound signals similar to the notable sound signal. Similar sound signals may be, for example, sound signals with similar levels, sound signals from similar directions, sound signals within similar frequency ranges, etc. As such, the determination of whether recipient tendencies have been established for sound signals similar to the notable sound signal may be based on any of the information stored in the recipient's hearing outcome profile.

Since the techniques presented herein are implemented in the background outside of a clinical setting, caregivers or other individuals can be useful in assisting the hearing outcome tracking module 118 to establish recipient tendencies (i.e., to build a hearing outcome profile) by creating louds sounds behind the recipient from time to time in different environments. Such contributions can help establish how the recipient responds to certain sounds in certain environments.

It is to be appreciated that 374 of FIG. 3B includes the operations for identification of recipient tendencies. However, the process to identify recipient tendencies is not necessarily associated (e.g., in time) with the storage of profile entries. Instead, the process to identify recipient tendencies may operate continually or periodically in the background.

If it is determined at 374 that the recipient tendencies have not been established, then the method 360 returns to 362 where the sound environment is monitored for additional sound signals. However, if it is determined at 374 that the recipient tendencies have been established, then method 360 proceeds to 376 where the results of the most recent correlation of the direction of arrival of the sound signal to head motion is compared to previously recorded sounds and head movements (i.e., to established recipient tendencies). At 378, a determination is made as to whether or not there is a significant variance/difference between the results of the most recent correlation relative and the recipient's established tendencies. If there is no significant variance, then the method 360 returns to 362 where the sound environment is monitored for additional sound signals. However, if there is a significant variance between the results of the most recent correlation and the recipient's established tendencies, then method 360 proceeds to 380 where one or more corrective actions are initiated.

There are a number of corrective actions that may be initiated when there is a significant variance between the results of the most recent correlation and the recipient's established tendencies. In certain embodiments, operation of the cochlear implant 100 is adjusted based on the variance (e.g., automated device reconfiguration, such as boosting gain for certain frequencies). Other corrective actions include providing at least one of the recipient or a caregiver with an indication of the variance, transmitting the indication of the variance to a remote fitting system for analysis by an audiologist, etc.

In general, it is to be appreciated that the order of the steps/operations shown in FIG. 3B are merely illustrative and may change in different embodiments. For example, it is possible that step 364 (i.e., identification of a notable sound) could precede step 354 (i.e., the generation of head motion data). It is also to be appreciated that certain steps/operations may be omitted, and other steps/operations may be added. For example, as noted above, FIG. 3B illustrates operations at 368 that identify sound direction to head movement correlations that have been affected by the recipient's listening situation and that may be discarded from further analysis as part of the operations at 370. It is to be appreciated that the operations at 368 and 370 are illustrative of one particular implementation and that, in alternative embodiments, one or both of the operations at 368 and 370 may be omitted. In such certain such embodiments, correlations of the direction of arrival of all notable sounds to corresponding head motion are recorded and stored in a recipient's hearing outcome profile along with situational data. As such, the operations of 368 may be part of the analysis of 374 to establish recipient tendencies. Alternatively, the operations of 368 may be incorporated in the correlation operations of 356 (i.e., the correlation further includes an analysis of situational data).

Also as noted above, FIG. 3B illustrates operation 364 that is used to determine whether or not a sound signal is a notable sound signal and operation 366 where non-notable sound signals are discarded. It is to be appreciated that the operations at 364 and 366 are illustrative of one particular implementation and that, in alternative embodiments, the operations at 368 and 370 may be omitted. For example, in certain such embodiments, correlations of the direction of arrival of all sound signals with the corresponding head movements are recorded and stored in a recipient's hearing outcome profile along with the non-directional sound signal parameters (and possibly situational data if the operations of 368 and 370 are also omitted). As such, the non-directional sound signal parameters (e.g., level, frequency, etc.) can be used as part of the analysis of 374 to establish recipient tendencies. Alternatively, the operations of 364 may be incorporated in the correlation operations of 356 (i.e., the correlation includes an analysis of non-directional sound signal parameters).

Figure 7:
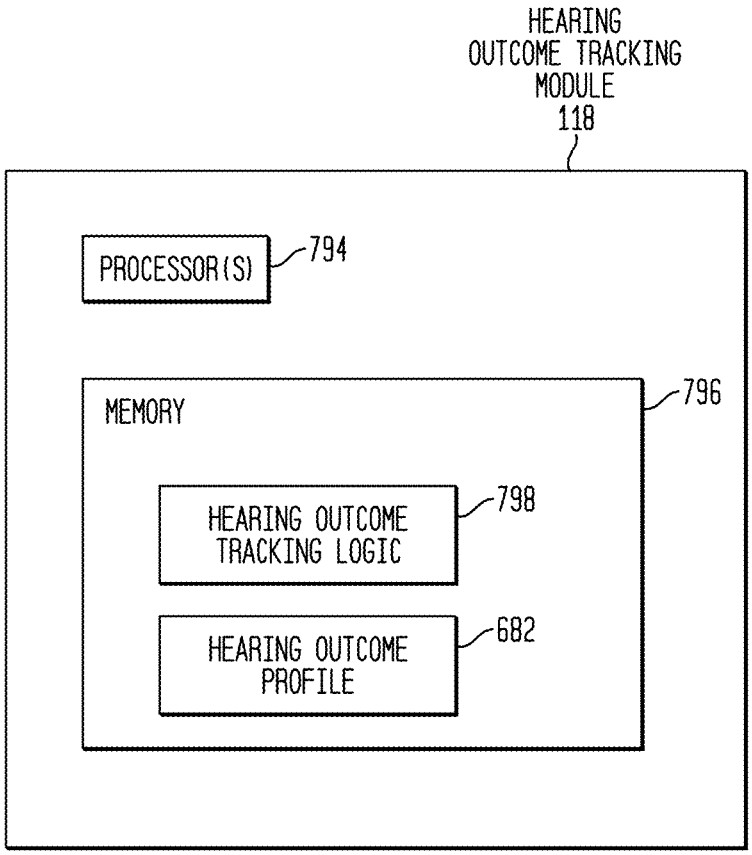
FIG. 7 is a block diagram of a hearing outcome tracking module in accordance with embodiments presented herein.

FIG. 7 is a schematic block diagram illustrating an arrangement for hearing outcome tracking module 118 in accordance with an embodiment of the present invention. As shown, the hearing outcome tracking module 118 includes one or more processors 794 and a memory 796. The memory 796 includes hearing outcome tracking logic 798 and a hearing outcome profile 682.

The memory 796 may be read only memory (ROM), random access memory (RAM), or another type of physical/tangible memory storage device. Thus, in general, the memory 796 may comprise one or more tangible (non-transitory) computer readable storage media (e.g., a memory device) encoded with software comprising computer executable instructions and when the software is executed (by the one or more processors 794) it is operable to perform the operations described herein with reference to hearing outcome tracking module 118.

FIG. 7 illustrates a specific software implementation for hearing outcome tracking module 118. However, it is to be appreciated that hearing outcome tracking module 118 may have other arrangements. For example, hearing outcome tracking module 118 may be partially or fully implemented with digital logic gates in one or more application-specific integrated circuits (ASICs). Alternatively, the one or more processors 794 of hearing outcome tracking module may be the same or different processor as the sound processor 112 (FIGS. 1 and 2).

As noted above, hearing outcome tracking module 118 receives sound signal data, head motion data, and situational data from one or more different sources (e.g., sound processor 112, inertial measurement unit 120, etc.). When the hearing outcome tracking module 118 is integrated in the same device as the sources of sound signal data, head motion data, and situational data, the hearing outcome tracking module 118 may receive the data via direct connections (e.g., wires). However, as noted elsewhere herein, the hearing outcome tracking module 118 may be separate from the devices/components that generate one or more of the sound signal data, head motion data, and situational data. For example, the hearing outcome tracking module 118 may be implemented on a mobile computing device carried by a recipient of a hearing prosthesis, while the sound processor and inertial measurement unit may be incorporated in a hearing prosthesis. Alternatively, the inertial measurement unit could be located in a device that is separate from the hearing prosthesis (e.g., incorporated in eyeglasses worn by the recipient). As such, in certain embodiments, the hearing outcome tracking module 118 has the ability to, or is connected to a component that has the ability to, receive data from other devices (e.g., wireless receiving capabilities).

Described above are techniques to utilize the functionality of accelerometers or other sensors, in combination with signal processing capabilities, including directionality, to identify hearing outcome problems (e.g., declines) without the need for recipient or caregiver intervention or a trip to the clinic. In particular, if a recipient's name is called out, a door slams shut, a horn blows, a person yells, etc., particularly from behind, the recipient should respond with a head turn, a duck, a jump, etc. All of these sounds can be detected and recorded by the hearing prosthesis, along with any corresponding head movements. Over time, identifying, recording and analyzing data about these sounds and corresponding head movements enables the prosthesis to identify and respond to the detected declines. A decline could relate to the residual hearing of the recipient, cochlea function for bone conduction and acoustic prosthesis recipients, cognitive abilities of any recipient, prosthesis operation, particularly prostheses with an actuator, etc. Resulting responses (corrective actions) can include an adjustment to the fitting or configuration of the prosthesis or a notification for the recipient, a caregiver or a hearing professional about the decline.

As noted, embodiments of the present invention have been primarily described with reference auditory/hearing prostheses and, more particularly, cochlear implants. However, also as noted above, it is to be appreciated that the techniques presented herein may be used with other types of sensory prostheses.

More specifically, as noted above, hearing loss is not the only type of sensory impairment such that other types of sensory prostheses are desirable. For instance, a person with vision impairment might be the recipient of a bionic eye. Such persons should be expected to respond appropriately to the visual scene sensed by the bionic eye. Thus, such persons might be expected to look in the direction of, focus on or otherwise respond to an element of the visual scene in the periphery of the visual scene sensed by the bionic eye, e.g., a fast approaching car. For such devices, the direction of arrival of a sensory input might correspond to the direction the recipient of a bionic eye must look in order to look directly at the element of the visual scene.

Further, persons without sensory impairment might benefit from the systems and methods described herein, e.g., experience a sensory enhancement rather than a sensory restoration. Thus, consumer electronic devices equipped with an inertial measurement unit (IMU), one or more microphones and the processing power required to determine the direction of arrival of a sound can provide a useful benefit to users of such devices. Therefore, in general, embodiments of the present invention may include determining, with a sensory prosthesis worn on the head of a recipient, a direction of arrival of a sensory input detected by the sensory prosthesis. The sensory prosthesis may be further configured to correlate the direction of arrival of the sensory input with movement of the recipient's head captured following detection of the sensory input.

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A hearing prosthesis system, comprising:

one or more microphones configured to detect a sound signal;

at least one processor configured to determine an arrival direction of the sound signal;

a memory;

an inertial measurement unit configured to generate one or more inertial measurements representing motion of the head of a recipient of the hearing prosthesis system following detection of the sound signal; and a hearing outcome tracking module configured to:

associate the one or more inertial measurements representative of the motion of the head of the recipient with the arrival direction of the sound signal; and store the association of the one or more inertial measurements representative of the motion of the head of the recipient with the arrival direction of the sound signal in the memory.

2. The hearing prosthesis system of claim 1, wherein the hearing outcome tracking module is configured to analyze the inertial measurements representative of the motion of the head of the recipient relative to the arrival direction of the sound signal to determine whether the motion of the recipient's head was consistent with an expected head motion.

3. The hearing prosthesis system of claim 2, wherein the hearing outcome tracking module is configured to analyze the inertial measurements representative of the motion of the head of the recipient relative to the arrival direction of the sound signal only when the arrival direction of the sound signal is from a spatial region directly behind the head of the recipient.

4. The hearing prosthesis system of claim 2, wherein the hearing outcome tracking module is configured to analyze the inertial measurements representative of the motion of the head of the recipient relative to the arrival direction of the sound signal only when the arrival direction of the sound signal is from a spatial region that is not visible to the recipient, at the time the sound signal is detected, without movement of the recipient's head.

5. The hearing prosthesis system of claim 2, wherein to analyze the inertial measurements representative of the motion of the head of the recipient relative to the arrival direction of the sound signal to determine whether the motion of the recipient's head was consistent with an expected head motion, the hearing outcome tracking module is configured to:

compare the one or more inertial measurements and associated arrival direction with a profile representing head movement tendencies of the recipient in response to sound signals detected by the hearing prosthesis; and determine, based on the comparison, whether the recipient is suffering a hearing outcome problem.

6. The hearing prosthesis system of claim 5, wherein the hearing outcome problem is at least one of a decline in the recipient's residual hearing, a decline in the recipient's cognitive ability, and a decline in the operation of the hearing prosthesis.

7. The hearing prosthesis system of claim 5, wherein the hearing outcome problem is an improper fitting of the hearing prosthesis to the recipient.

8. The hearing prosthesis system of claim 1, comprising:

a hearing prosthesis; and a mobile computing device configured to operate with the hearing prosthesis, wherein the memory and hearing outcome tracking module are located on the mobile computing device.

9. A method, comprising:

determining, with a sensory prosthesis worn on the head of a recipient, a direction of arrival of a sensory input detected by the sensory prosthesis;

correlating the direction of arrival of the sensory input with movement of the recipient's head captured following detection of the sensory input; and recording one or more of the direction of arrival, a level, a frequency, and a frequency range of the sensory input.

10. The method of claim 9, wherein the sensory prosthesis comprises a hearing prosthesis and wherein the sensory input comprises a sound signal.

11. A method, comprising:

determining, with a sensory prosthesis worn on the head of a recipient, a direction of arrival of a sensory input detected by the sensory prosthesis;

correlating the direction of arrival of the sensory input with movement of the recipient's head captured following detection of the sensory input; and correlating the arrival direction of the sensory input with the movement of the recipient's head only when the direction of arrival of the sensory input is from a spatial region that is not visible to the recipient, at the time the sensory input is detected, without movement of the recipient's head.

12. The method of claim 11, further comprising:

correlating the arrival direction of the sensory input with the movement of the recipient's head only when the direction of arrival of the sensory input is from a spatial region directly behind the head of the recipient.

13. The method of claim 11, wherein the sensory prosthesis comprises a hearing prosthesis and wherein the sensory input comprises a sound signal.

14. A method, comprising:

determining, with a sensory prosthesis worn on the head of a recipient, a direction of arrival of a sensory input detected by the sensory prosthesis;

correlating the direction of arrival of the sensory input with movement of the recipient's head captured following detection of the sensory input;

determining a level of the sensory input; and correlating the arrival direction of the sensory input with movement of the recipient's head only when the level is above a threshold.

15. The method of claim 14, wherein the threshold is a difference between an ambient noise level and the level of the sensory input.

16. A method, comprising:

determining, with a sensory prosthesis worn on the head of a recipient, a direction of arrival of a sensory input detected by the sensory prosthesis;

correlating the direction of arrival of the sensory input with movement of the recipient's head captured following detection of the sensory input;

determining whether the sensory input corresponds to one or more selected words, phrases, or voice characteristics; and correlating the arrival direction of the sensory input with movement of the recipient's head only when the sensory input corresponds to one of the one or more selected words, phrases, or voice characteristics.

17. The method of claim 16, wherein at least one of the one or more selected words comprises a name of the recipient.

18. The method of claim 17, further comprising:

training the sensory prosthesis to identify sensory inputs that include the recipient's name.

19. A method, comprising:

determining, with a sensory prosthesis worn on the head of a recipient, a direction of arrival of a sensory input detected by the sensory prosthesis, wherein the sensory prosthesis includes an environmental classifier configured to classify a sound environment of the sensory prosthesis;

correlating the direction of arrival of the sensory input with movement of the recipient's head captured following detection of the sensory input; and recording a classification of a sound environment by the environmental classifier at the time the sensory input is detected by the sensory prosthesis.

20. A method, comprising:

determining, with a sensory prosthesis worn on the head of a recipient, a direction of arrival of a sensory input detected by the sensory prosthesis;

correlating the direction of arrival of the sensory input with movement of the recipient's head captured following detection of the sensory input; and recording an activity level of the recipient at the time the sensory input is detected by the sensory prosthesis.

21. A method, comprising:

determining, with a sensory prosthesis worn on the head of a recipient, a direction of arrival of a sensory input detected by the sensory prosthesis;

correlating the direction of arrival of the sensory input with movement of the recipient's head captured following detection of the sensory input;

determining that the recipient has head movement tendencies following detection of sensory inputs similar to the sensory input;

comparing the recipient's head movement tendencies to the results of the correlation of the arrival direction of the sensory input with the movement of the recipient's head; and based on the comparing, determining if there is a variance between the head movement tendencies and the correlation of the arrival direction of the sensory input with the movement of the recipient's head.

22. The method of claim 21, wherein when there is variance between the head movement tendencies and the results of the correlation of the arrival direction of the sensory input with the movement of the recipient's head, the method further comprises:

adjusting operation of the sensory prosthesis based on the variance.

23. The method of claim 21, wherein when there is variance between the established head movement tendencies and the results of the correlation of the arrival direction of the sensory input with movement of the recipient's head, the method further comprises:

providing at least one of the recipient or a caregiver with an indication of the variance.

* * * * *